US006949018B2

(12) United States Patent
Bleier

(10) Patent No.: US 6,949,018 B2
(45) Date of Patent: Sep. 27, 2005

(54) APPARATUS FOR FINISHING SURFACES

(76) Inventor: Larry P. Bleier, 205 Washington Ave., Endicott, NY (US) 13760

( * ) Notice: Subject to any disclaimer, the term of this patent is extended or adjusted under 35 U.S.C. 154(b) by 0 days.

(21) Appl. No.: 09/988,419

(22) Filed: Nov. 16, 2001

(65) Prior Publication Data

US 2002/0102926 A1 Aug. 1, 2002

Related U.S. Application Data

(60) Division of application No. 09/564,902, filed on May 4, 2000, now Pat. No. 6,361,408, which is a division of application No. 08/983,396, filed on Apr. 8, 1998, now Pat. No. 6,074,293, which is a continuation-in-part of application No. 08/510,530, filed on Aug. 2, 1995, now abandoned.

(51) Int. Cl.[7] ..... B24F 21/03

(52) U.S. Cl. ..... 451/461; 451/558; 451/540; 451/537

(58) Field of Search ..... 451/558, 540, 451/555, 554, 522, 552, 321, 320, 312, 371, 319, 461; 76/82, 89.1

(56) References Cited

U.S. PATENT DOCUMENTS

| | | | | |
|---|---|---|---|---|
| 629,125 A | | 7/1899 | Erskine | |
| 730,706 A | * | 6/1903 | Rose | 451/549 |
| 823,279 A | | 6/1906 | Kellogg | |
| 1,091,158 A | | 3/1914 | Orkin | |
| 1,451,396 A | | 4/1923 | Jones | |
| 2,479,767 A | | 8/1949 | Murchison | |
| 2,743,561 A | * | 5/1956 | Franks | 451/555 |
| 2,798,344 A | * | 7/1957 | Hertel | 451/556 |
| 3,797,334 A | * | 3/1974 | Sinclair | 76/88 |
| 4,272,925 A | | 6/1981 | Graves | |
| 4,696,129 A | * | 9/1987 | Roberts | 451/555 |
| 4,773,186 A | | 9/1988 | Kojima | |
| 5,046,385 A | | 9/1991 | Cozzini et al. | |
| 5,101,600 A | * | 4/1992 | Morris et al. | 451/513 |
| 5,520,574 A | * | 5/1996 | Wilson | 451/540 |
| 6,074,293 A | * | 6/2000 | Bleier | 451/558 |

FOREIGN PATENT DOCUMENTS

| | | |
|---|---|---|
| DE | 75 13 884 | 6/1977 |
| DE | 39 34 365 C1 | 2/1991 |
| GB | 2 040 744 A | 1/1980 |
| WO | WO 87/00108 | 1/1987 |

OTHER PUBLICATIONS

"The Sharpening of Scaling Instruments: I. An Examination of Principles" by Omer E. Paquette and Marvin P. Levin, *Sharpening I,* pp. 163–168.

"Engineering Specifics of the Periodontal Curet's Cutting Edge" by Ben Balevi, *J Periodontol* 1996;67:374–378.

* cited by examiner

*Primary Examiner*—George Nguyen
(74) *Attorney, Agent, or Firm*—Frommer Lawrence & Haug LLP; Ronald R. Santucci

(57) ABSTRACT

A method is described for surface finishing complex and simple surface shapes by abrasion of selected zones of surface, leaving contiguous zones unfinished.

15 Claims, 7 Drawing Sheets

APPARATUS FOR FINISHING SURFACES

CROSS-REFERENCE TO RELATED APPLICATIONS

This application is a division of U.S. patent application Ser. No. 09/564,902 filed May 4, 2000 now U.S. Pat. No. 6,361,408 entitled "Method and Apparatus for Finishing Surfaces" which is a division of U.S. patent application Ser. No. 08/983,396, now U.S. Pat. No. 6,074,293, filed Apr. 8, 1998 entitled "Apparatus for Finishing Surfaces" which is a Continuation-In-Part of my copending U.S. patent application Ser. No. 08/510,530 filed Aug. 2, 1995, now abandoned.

FIELD OF THE INVENTION

The invention relates to finishing metallic and non-metallic surfaces by abrasion techniques.

BRIEF DESCRIPTION OF RELATED ART

The literature is replete with descriptions of apparatus and methods for finishing the surfaces of a variety of articles of manufacture. Representative of such articles are tools and instruments, many having complex geometric shapes and curvilinear surfaces.

One of the problems in finishing complex surfaces, especially curvilinear surfaces, is the need to draw the article across an abrasive surface while continuously changing the angle so as to accommodate the geometric shape thereof. The finishing of complex surfaces usually requires skilled hands and experienced craftspeople. Even experts find it difficult to follow many complex surface shapes, due to the demanding control required.

In the manufacturing industry, establishing conditions for a finishing process to obtain a specified surface topography is also not problem free, since many interacting factors are involved. Under ideal circumstances, the factors to be considered involve the operational setting of the machine (e.g., the geometric characteristics of the abrasive tool, the work speed, the tool feed rate and the type of cutting fluid used). Even under ideal conditions it has been only possible to calculate the theoretical roughness developed in a machining operation for the simplest process, i.e., single-point tool cutting. The fact that it is not possible to fully specify the character and surface roughness scale and topography of a surface remains a serious problem for production/design engineers.

One aspect of the present invention concerns the finishing of surfaces on tools and instruments. For example, dental, veterinary and medical instruments may have sophisticated shapes which can only be obtained with an exacting and complex finishing procedure.

For example, the U.S. Pat. No. 4,509,268 (Marquam et al.) and U.S. Pat. No. 4,821,462 (Moore) describe apparatus for sharpening dulled surfaces of dental curets. Marquan et al. says "A common sharpening error encountered is failure to restore the cutting edge to the proper angle. Another common error is failure to maintain the proper blade shape with the cutting edges parallel and the toe smoothly rounded". Marquam et al. approaches the problem by providing an adjustable protractor-like guide for positioning the curet blade at a proper angle with a flat sharpening stone. The operation of the guide requires the operator to determine the proper angle (various curets having different blade angles) and to sight along the guide to determine that the proper angle has been selected. It is necessary to re-position the curet for a second blade edge angle. Moore in the later U.S. Pat. No. 4,821,462 describes a similar protractor device, improved by the association with a pair of flat, spaced apart sharpening stones and an index for identifying the proper angle of an inserted blade. The difficulty with both devices remains in that a degree of training and expertise is required to use them, including the knowledge of proper angles required. In the hands of the untrained, a curet can be damaged beyond repair.

The present invention is an apparatus that will accurately provide an exactly shaped cutting edge to a dental curet. The apparatus not only provides an exact shape for the curet cutting edge, but it does so with precision every time. A reason that this apparatus works so well is its simplicity. With this apparatus, the dentist or technician performing the finishing need not be as careful in drawing the instrument across the abrasive surface. Although the instrument itself is generally held at certain angles with respect to the abrasive surface, even this is not critical. The apparatus of the invention has one or more specifically shaped abrasive surfaces to guide and finish the instrument surface. These abrasive surfaces create an exact shape for the cutting edge of the curet. The shape provides the fineness and delicacy of its original design. Reported at the recent 1996 World Workshop in Clinical Periodontics, was the extensive review of the current literature by Quirynen and Bollen. Using an evidenced based approach, they concluded that both surface free energy and roughness play major roles in the initial adhesion and retention of oral microbes. Quirymen and Bollen reported the above findings to be of sufficient importance to demand clinical attention during therapy, to achieve the smoothest possible root surface. Therefore, the abrasive surface component of the apparatus of the invention creates not only an exact shape of the desired cutting edge of a curet, but a cutting edge with the proper edge fineness and delicacy required in dentistry based on current research.

The present invention is, however, not limited to the finishing of tools and instruments for use in the medical, dental and veterinary arts. The present invention reflects the discovery that many surfaces can be carefully finished, shaped or sharpened to obtain the objectives required. This may be carried out by placing them in contact with abrasive surfaces that mirror completely, or partially and selectively, the desired surfaces of the objects to be finished. The present invention will aid in achieving the objectives of a specified manufacturing process (for example, surface topography or surface geometry, cross-sectional geometry, and surface finishing) by providing apparatus having abrasive surfacing contours that have selectively planned abrading contact areas and relief surfaces (non-contacting areas) to permit a desired outcome of a finishing process. One of the main advantages of this invention over the prior art is that the apparatus of the invention has built-in, selectively placed relief surfaces. By controlled movements of the tool or instrument, or part thereof, through the apparatus, one can impart a specific finish such as shaping, grinding, polishing, cleaning, buffing or sharpening to selected surface zones, while leaving other zones unfinished.

The movement of the tool or instrument, or part thereof, can be independently, or dependently with the abrasive surfaces and relief surfaces in multiple or single-spatial planes such as linear, elliptical, or circular, depending upon the finishing objectives and surface configuration.

The relief surfaces also provide a means by which abrasive residues can be removed from interfering with the apparatus operation during the finishing process and to direct introduced dry and liquid cutting fluids, lubricants and gases, such as graphites for temperature and lubrication control.

The relief surfaces provide a means by which certain surface zones on articles to be finished can be left undisturbed while contiguous zones are abraded or shaped. This results in the desired shape (by selectively abrading and selectively non-abrading).

This invention differs from the prior sharpening arts due to its selective, reshaping capabilities, as well as its ability to resharpen a tools' worn surfaces. In other words, surfaces can be selectively and specifically shaped to restore the complex angles and shapes of the working edges of an instrument, or a component of a complex machine or apparatus/device.

Metal surfaces are finished (non-metal can also be finished with the apparatus of the invention) by abrasion. Metal articles include, without limitation, screws, arrow heads, hammer heads and drill bits. Almost any instrument, tool or surface that can be drawn or turned on an abrasive surface can be finished by the apparatus of this invention.

The abrasive surfaces of the apparatus of the invention may be multi-segmented such as mirrored halves, which invertly correspond to the complex, geometric surface of the article to be finished. The article is placed in a first half of the apparatus and the corresponding, second half is then placed over the article. Depending on the surfaces to be finished, the article is then turned in or pushed into the apparatus. The forcing of the article through the apparatus causes a finishing of the surfaces of the article. If one defines the desired shape and surface finish (degree of smoothness), one can selectively place abrasives, lining those internal inverted channels to finish the article or surface according to desired specifications.

To date, there is no non-automated finishing device that will produce the proper cutting edge for the complicated, intricate type of instruments employed by hygienists, dentists, doctors and veterinarians. The earlier sharpening devices or procedures are very crude and unrefined with respect to maintaining small, delicate surface shapes of a curet. Additionally, the cutting edge of a dental curet is often delicately shaped during manufacture. The attempt to shape and, therefore, accurately reproduce this cutting edge to its original, precise surface configuration is rendered futile when utilizing a flat, sharpening stone.

The invention contemplates a variety of finishing processes. For example, finishing includes grinding, honing, shaping, polishing, cleaning and buffing. In other words, this invention has an objective that differs from simple sharpening required of such devices as razor blades, knives and other sharp edges having flat surfaces meeting at an edge. Human medical, veterinary and dental care require and deserve dental and medical instruments that are of superior and sophisticated shapes, shapes which must be maintained with exacting and complex detail.

SUMMARY OF THE INVENTION

The invention comprises apparatus for finishing a zone on the surface of an article of manufacture, said surface comprising a plurality of adjacent and contiguous zones, which comprises;

means for supporting a rigid abrasive surface;

an inflexible, abrasive surface supported on the means for supporting;

said abrasive surface having (i) a cross-sectional profile which is a negative image of the profile of the zone to be finished; and (ii) a relief corresponding to the zone or zones to remain unfinished.

The terms "finishing" and "finished" as used throughout the specification and claims are used in their dictionary sense as meaning to give a desired surface effect. The desired surface effect may be, for example, a smoothing, a roughening, or the removal of a blemish. The processes of "finishing" contemplated comprise abrasion, which is defined as a wearing away by rubbing or scraping. Abrasive procedures include sanding, buffing, honing, polishing, grinding, shaping, striating, sharpening, engraving and like procedures.

Articles of manufacture which may be finished employing the apparatus of the invention may be metallic or non-metallic in nature. Representative of such materials are wood, ceramic, synthetic or natural polymeric resins, minerals and metals or metal alloys and the like. Specific articles of manufacture include, without limitation, hardware, decorative hardware, tools, instruments, fasteners, vehicle components and parts, gears, screws, jewelry, tableware, glassware and the like. Of particular advantage for finishing with the apparatus of the invention are articles with compound surfaces, i.e., curvilinear or like complex shapes and angularities.

DETAILED DESCRIPTION OF THE PREFERRED EMBODIMENTS OF THE INVENTION

Figure 1:
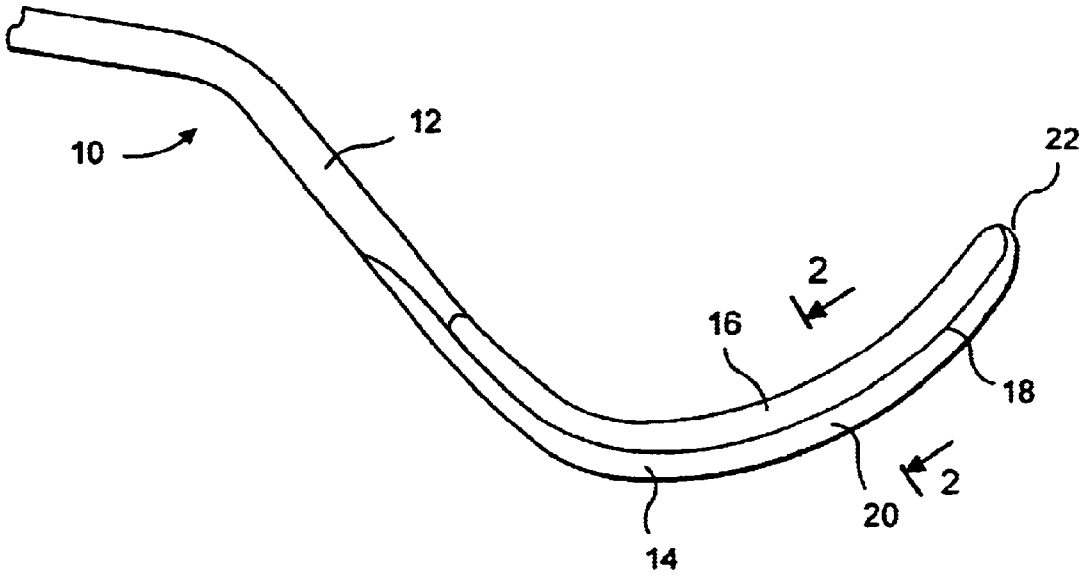
FIG. 1 PRIOR ART
FIG. 1 is a side view of the blade end of a Gracey curet (prior art).

Those skilled in the art will gain an appreciation of the invention from a reading of the following description of the preferred embodiments viewed with the drawings of the accompanying FIGS. 1–13. The apparatus of the invention is most advantageously used to finish the surfaces of curvilinear shaped surfaces.

It is well known in the dental, veterinary and medical arts that sharp, well maintained and properly shaped instruments provide better acuity and performance. This is universally true regarding each and every medical, veterinary or dental instrument having a cutting or probing edge. The apparatus of the invention is particularly advantageous for use in finishing cutting surfaces of medical, veterinary and dental instruments. For example, dental scaling instruments, some of which have long, curved cutting edges, such as curets, need to be sharpened frequently in order to function in the efficacious removal of bacterial plaque, calculus (tartar deposits), and necrotic and/or diseased cementum from the surfaces of teeth crowns and their roots; see for example the U.S. Pat. No. 4,821,462 described above. The sharpening of the curved edge of the scaling tool produces a scaling surface that more readily and easily removes scale from a tooth, and the creation of the smoothest possible surface and shape of the treated tooth. Scale removal can be improved by a finishing of the scaler's edge; this can also be accomplished with the exertion of less pressure. Such finishing also results in providing a dentist or technician with an increase in tactile sensitivity, dexterity and control of the instrument. These instruments are placed below the gingiva and especially between adjacent tooth surfaces and when out of visual contact, there is a required dependency on increased tactile sensitivity for their use.

Dental scalers are usually sharpened and shaped on a flat stone with a repeated reciprocal stroking, in a fashion that is similar to sharpening a knife blade. The difference, however, between the procedure of sharpening a knife blade and that of sharpening and shaping a dental scaling instrument is the degree of exercised control required in order to produce the optimum, i.e., the proper surface finish. In providing a keen edge for a curet the exact angle at which the instrument contacts the sharpening stone is critical. For purposes of this description, the word "curet" is used to refer to all medical and dental instruments in the class, including, but not limited to, curets or "curettes", scalers, hoes, files, sickles, explorers, and the like.

In dentistry, the use of curets is well known. These have acute cutting edges, which dull quickly with use. In fact, due to the frequency with which these cutting edges become dull and worn, during clinical use, the human tendency is to neglect sharpening them as often as necessary.

The device currently used to sharpen the cutting edge of a curet is a flat, abrasive stone. While the abrasive stone is adequate for the sharpening of some simple scaling instruments, it does not accurately and precisely finish the correct shape and surface of the more complex designs of many instruments used in dentistry, veterinary medicine and medicine.

Figure 2:
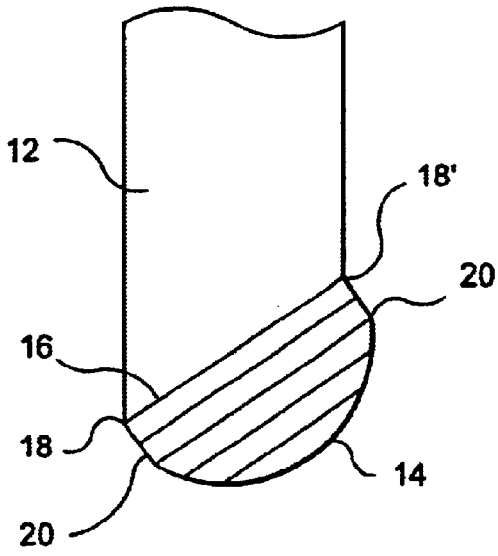
FIG. 2 PRIOR ART
FIG. 2 is a cross-sectional view along lines 2—2 of FIG. 1 (prior art).

Referring now to FIG. 1, there is seen a side view of a blade end of a Gracey curet as a representative prior art dental scaling instrument. The curet 10 has a shank 12, and a distal or blade end having a back 14, a face 16 and a cutting edge 18 delineated by the angular meeting between face 16 and lateral surface 20. The edge 18 terminates at the toe 22. Further details of the prior art curet 10 structure may be seen in FIG. 2, a cross-sectional view along lines 2—2 of FIG. 1. As seen in FIG. 2, a second cutting edge 18' is delineated at the boundary between lateral surface 20 and face 16. The lateral surface 20 is curvilinear, and forms a part of a circle or ellipse. For purposes of illustration, the cutting edges 18 and 18' are shown as sharp and angular (about 85 degrees) at the juncture of face 16 and the lateral surface 20. When the cutting edges 18 and 18' at their juncture with surface 20 are flattened from clinical use, a condition of dulling exists. To restore a sharp cutting edges 18 or 18' the lateral surface 20 must be abraded away to recreate the original clearance angle. It will be appreciated that, as described above, the curvature of surface 20 is critical if the original shape of the curet 10 is to be conserved while finishing and restoring the cutting edges 18 or 18' in sharpness. This is accomplished readily and easily using the apparatus of the invention.

Figure 3:
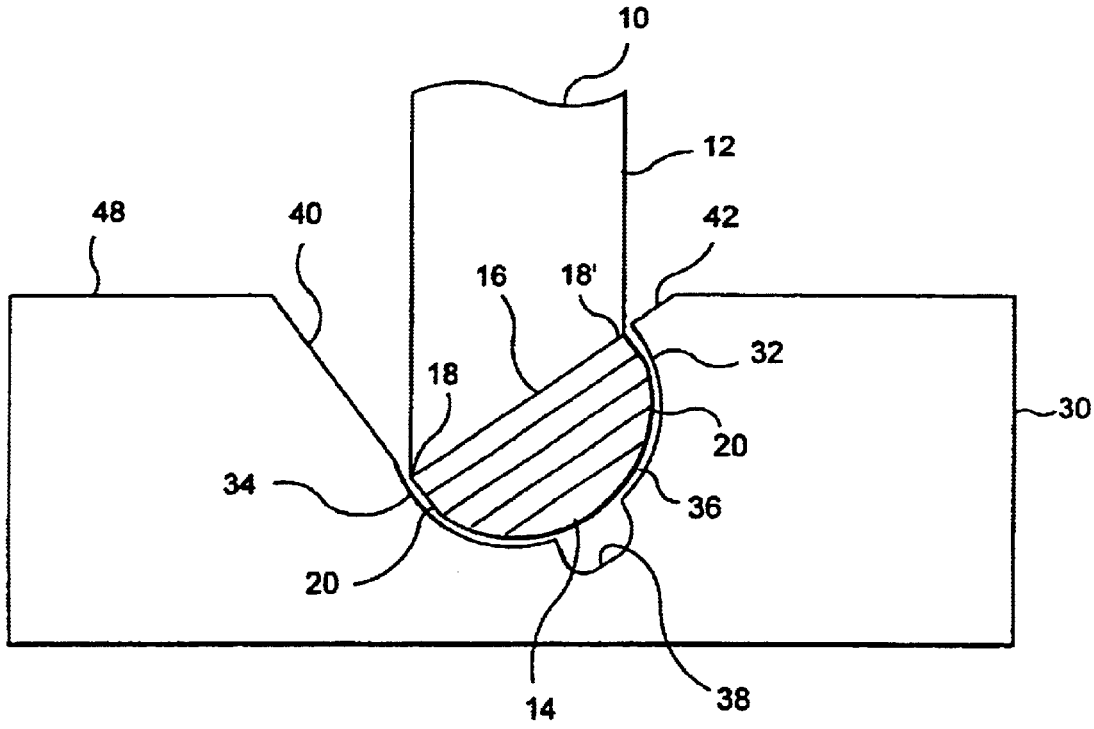
FIG. 3 is a cross-sectional side elevation (enlarged) of the Gracey curet shown in FIGS. 1 and 2, positioned in a schematic diagram of apparatus of the invention.

Referring now to FIG. 3, there is seen a schematic cross-sectional side elevation as shown in FIG. 2 (but enlarged) of the cutting edges of a Gracey curet 10 positioned in relationship to apparatus of the invention. The apparatus of the invention comprises a support means 30 for supporting an inflexible, rigid abrasive surface 32. As can be appreciated from FIG. 3, the abrasive surface 32 has a substantial portion which in cross-sectional profile is a negative image of the cross-sectional image of the lateral surface 20 of curet 10. In fact, the lateral surface 20 of curet 10 finds a corresponding mirror image in portions 34, 36 of abrasive surface 32. The portions 38, 40 and 42 of abrasive surface 32 are reliefs, not projecting towards the inserted curet 10 and therefore incapable of contact with any surface of the curet 10. In this way, during finishing of curet 10 lateral surface 20, the back 14 of curet 10 and the shank 12, which are surface zones contiguous to lateral surface 20 which remain unexposed to modification by finishing. For purposes of illustration, the lateral surfaces 20 adjacent to edges 18, 18' are shown in FIG. 3 as flattened, i.e., dulled. By abrading away portions of the lateral surface 20 to correspond them to the profile of abrasive surface 32, the original, sharp condition is restored. As shown in the FIG. 3, the lateral surface 20 adjacent to the cutting edge 18 will be abraded away by portion 34 of abrasive surface 32, thereby restoring the proper cutting edge 18 and configuration of the lateral surface 20, upon reciprocal motion of the curet 10 against portion 34 of abrasive surface 32. By movement of the shank 12 of curet 10 to the left, lateral surface 20 adjacent cutting edge 18' is brought into physical contact with portion 36 of abrasive surface 32 if one wishes to finish this cutting edge 18' and again lateral surface 20. Other types of curet, where the blade face 16 is horizontal to the normal (parallel to surface 48) can be finished in one movement against abrasive surface 32, since both portions 34, 36 will be in simultaneous contact with the lateral surface 20 adjacent both cutting edges 18, 18'.

Figure 4:
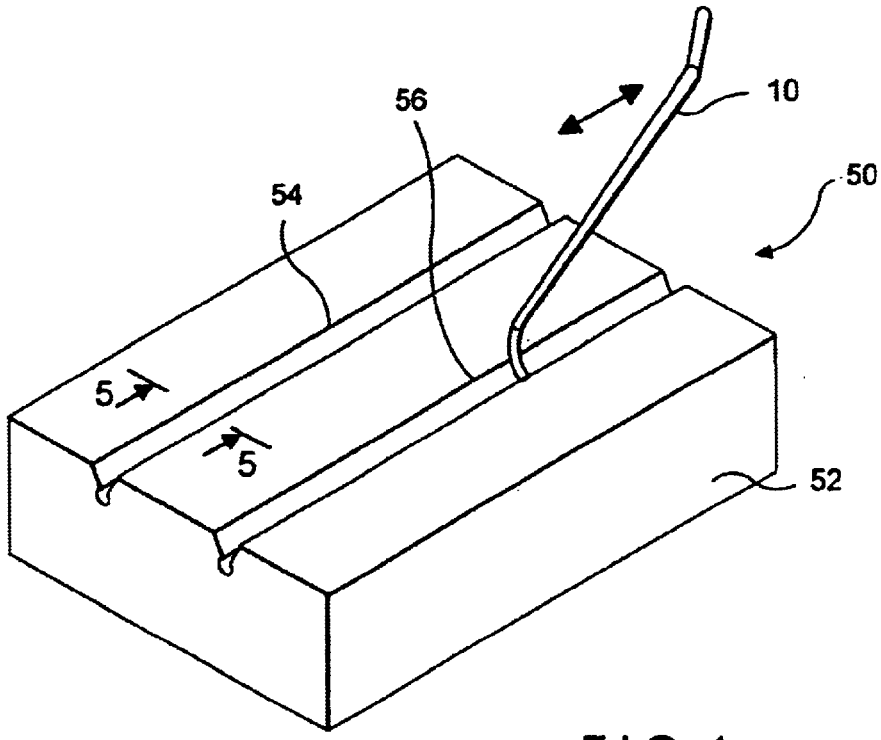
FIG. 4 is a view-in-perspective of one embodiment apparatus of the invention as seen from above.

Referring now to FIG. 4, there is seen a perspective view from above of an embodiment apparatus 50 of the invention. Apparatus 50 as a finishing apparatus and more particularly as a sharpening and shaping device comprises a block 52 of hardened abrasive material designed to abrade the lateral surfaces 20 of a dental curet. This block 52 is a support means 30 containing one or more honing channels (grooves 54, 56) that finish the lateral surface 20 of a curet 10 when it is inserted into the appropriate groove 54 or 56 and drawn against the abrasive surface 32. As shown in FIG. 4, the blade end of curet 10 is inserted into one of the grooves 54 or 56. The grooves 54 and 56 are lined with an abrasive surface 32 as described above, or an exposed surface of block 52, and having portions which are negative images (in cross-sectional profile) of the surface zones (portions of lateral surface 20) of curet 10 to be finished. The apparatus 50 can be manufactured with different grooves which correspond to the different blade end shapes and tip sizes that are needed for various dental, veterinary, or medical instruments. Drawing the cutting edge of the curet 10 through a particular groove will impart with precision a particular shape to the end of the tool. The working edge of the instrument so shaped by this invention will then be provided with a cutting edge that will approach the original precision of the original item.

Those skilled in the art will appreciate from the description above of the apparatus of the invention that in one embodiment, there is provided a finishing device for dental scaling instruments. The shaping and sharpening device is designed to restore both the original, precise sharpness and shape to the tip or blade of a surgical instrument. The sharpening and shaping device comprises a block of abrasive material such as ceramic or aluminum oxide. The block as a support means 30 comprises on its surface at least one groove having a specific, cross-sectional profile of abrasive surface 32.

As may be observed from FIG. 3, the cross-sectional side profile of the abrasive surface 32 includes portions which are negative images of the surface zones to be finished. Other portions or zones are relieved so as to avoid contact with any portion of the surface or the article to be finished. The profile of the abrasive surface 32 may be widely varied, depending on the article to be finished and the surface zones to be finished while excluding or not touching contiguous zones of the surface which are to remain unfinished. Thus, for example, the cross-sectional profile may consist of a rounded abrasive wall and a square, sub-wall non-abrasive footing or relief; a V-shaped abrasive wall having a rounded, non-abrasive sub-wall footing or relief; or a rounded abrasive wall having a V-shaped, non-abrasive sub-wall footing or relief. Each of these various cross-sectional profiles is intended to impart a particular, specific shape or geometry to a surface such as a surgical tool like a dental curet in order to enable such a tool to function with accuracy and precision. These differently-shaped profiles can be made in a plurality of sizes so as to accommodate instrument tips and surfaces of different sizes. The conventional dental tool known as the curet has two different ends, each having a similarly shaped blade. The abrasive cross-sectional profiles of the apparatus of the invention allow for the sharpening and shaping of either end of a dental curet and does so whether the instrument is new or used and worn.

Figure 5:
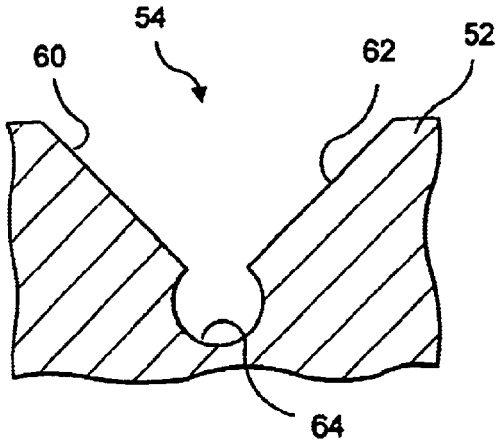
FIG. 5 is a cross-sectional side elevation along lines 5—5 of FIG. 4.
Figure 6:
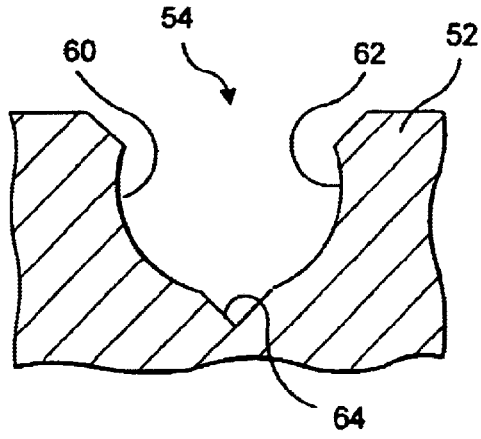
FIGS. 6–9 are cross-sectional side elevations of alternate embodiment abrasive surfaces employed in the apparatus of the invention.
Figure 7:
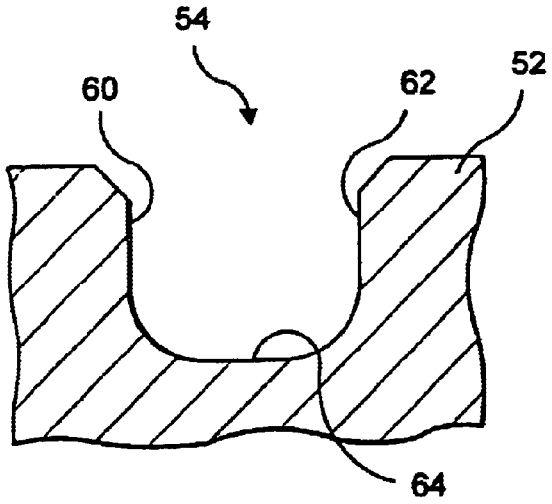
Figure 8:
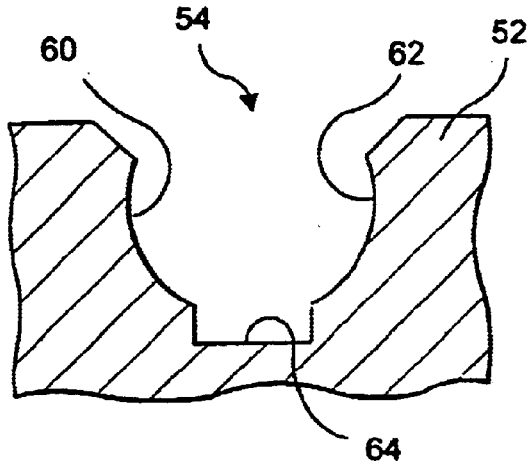
Figure 9:
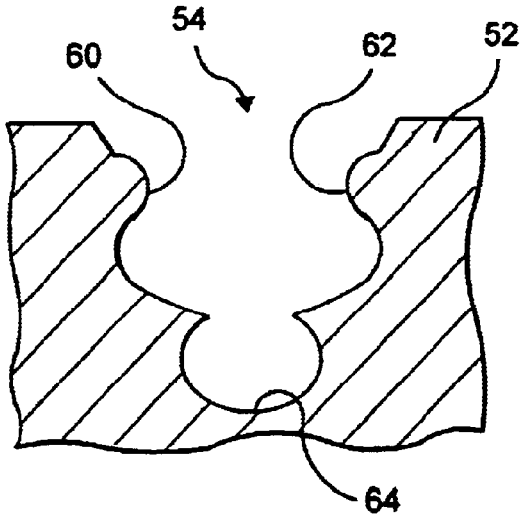
Figure 10:
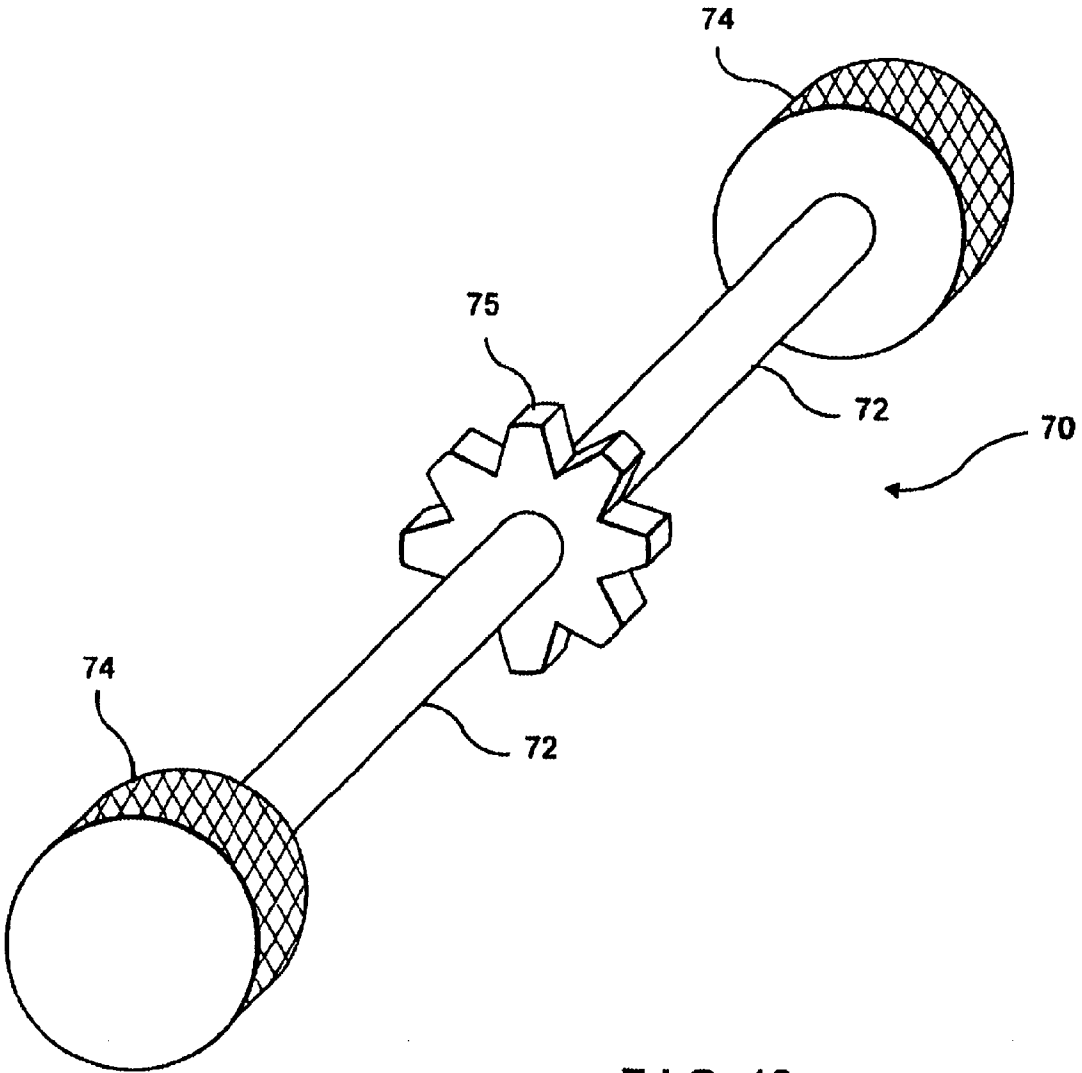
FIG. 10 PRIOR ART
FIG. 10 is a perspective view of a prior art article of manufacture finished with the use of apparatus of the invention.

Referring now to FIG. 5, there is seen a cross-sectional view along lines 5—5 of FIG. 4. This view illustrates further the profile in cross-section of an abrasive surface 32 within the confines of a groove 54 or 56. In the embodiment shown in FIG. 5, the groove 54 or 56 as defined by the abrasive surface 32 is a negative image of a curved sickle scaler blade end in portions 60, 62. Below portions 60, 62 is a relief portion 64 which does not make contact with the back of the curved sickle scaler, thus preserving the back from loss of metal through abrasion. As examples of other profiles for differently shaped articles to be finished, refer now to FIGS. 6–9, where the numerals 60, 62 indicate abrasive surface 32 portions which are negative images of the surface to be finished and the numeral 64 indicates a relief portion of non-contact. The relief portions 64 themselves may have a wide variety of cross-sectional side profiles, ranging from square to oval or elliptical. When the surface to be finished is linear or relatively flat, the relief portion 64 is advantageously below the cutting portions 60, 62. Where the article to be finished has a curvilinear surface, for example a curet 10, the relief portion 64 may be below or above the abrasive portions 60, 62.

The relief surface also prevents portions of the dental cool from weakening during the sharpening and shaping process and can provide support for a portion of the dental tool. The relief portion generally corresponds to a part of the instrument or tool not involved in shaping or sharpening which, if worn, could weaken the strength of the instrument, and which could break in treatment due to unnecessary loss of cross-sectional diameter. It should be understood that Teflon® coating or other non-abrading material (e.g. metal) can be deposited into at least one of the surfaces 60, 62 so that only intended instrument surface(s) of the dental tool can be selectively sharpened and/or shaped. In FIGS. 5–9 the relief portion can be any of the cross-sectional surfaces or sides 60, 62, or 64 of the groove 54 as dictated by the specific instrument design.

The apparatus 50 of the invention may be operated as follows.

For example, the tip or blade edge of a dull and/or worn curet 10 is sharpened and shaped by the apparatus of the invention by inserting the blade or tip of the curet into an appropriate groove 54, 56 as illustrated in FIG. 4. The dentist or technician then proceeds to draw the tip of the curet 10 through the groove 54 or 56 in the directions shown by the arrow, using a steady force. Alternatively, the apparatus 50 may be moved and the curet 10 held steady. In this manner, the lateral surface 20 of the curet 10 is accurately shaped by the negative image profiled abrasive surface 32. The relief portion 64 of the apparatus 50 provides non-abrasive clearance for specific selected surface areas of the curet 10 so as to avoid weakening by excessive unnecessary abrasion. The relief 64 of the apparatus correctly aids in the shaping of the instrument, which heretofore, could not be maintained when abraded across or against a flat abrasive surface.

Again, with reference to FIG. 4, the apparatus 50 has a generally flat upper surface and is made of hardened abrasive material to abrade select zones of metal surfaces on curet 10, thus sharpening and shaping it. The curet 10 is held by the dentist, while one of the respective two ends, is inserted and drawn through the appropriate groove 54 or 56, in order to sharpen and shape the blade or cutting edge of curet 10.

The curet 10 is generally held to correspond the tip of the dental curet 10 to the particular shape of the groove 54 or 56, as described above in relation to FIG. 3. After the curet 10 is inserted into the groove 54 or 56, the tip is drawn linearly through the groove (arrow) of the block 52, thus imparting the proper shape and sharpness to the blade or tip end.

The block 52 may be generally fabricated from a hardened, abrasive material such as a ceramic, aluminum oxide or metal carbide (such as tungsten carbide). The block 52 may be manufactured by dry powder compaction techniques, or by extruding the material through a die, in which case the abrasive surface 32 is an exposed surface of the abrasive block 52. In an alternate embodiment, block 52 may be fabricated from a plurality of different abrasive materials, so that the abrasive surface 32 is a composite of different abrasive materials, each selected for its particular affect on article surfaces to be finished. For example, where a coarse abrasion is required, the corresponding negative image portion of abrasive surface 32 may have a coarser abrasive than an adjacent zone where the corresponding surface portion of the article is only to be polished.

Figure 11:
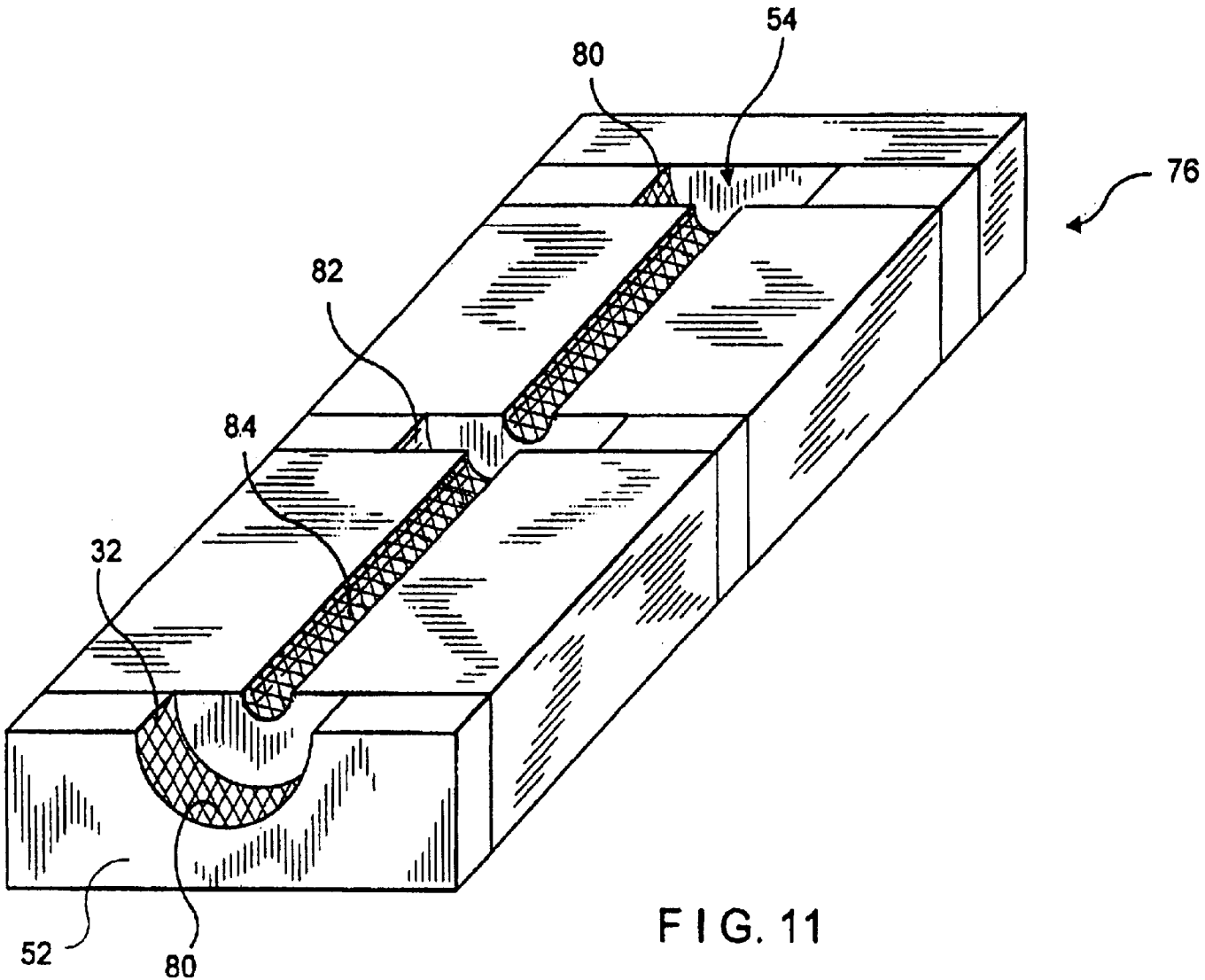
FIG. 11 is a view-in-perspective of another embodiment apparatus of the invention.

The instruments heretofore described as finished by the apparatus of the invention described above, are non-symmetrical in shape and are finished in accordance with the invention by moving them in a substantially straight line along a shaped or profiled abrasive surface. However, some articles of manufacture are substantially symmetrical and have surfaces for finishing which are curved, rounded or elliptical in a symmetrical configuration. As an example of such an article of manufacture is a thumb-turning tuning control rod (article of manufacture) shown in a perspective view in FIG. 10 (prior art). The rod 70 comprises a smooth shaft 72 having thumb-turning knobs 74 at either end and a gear 75 in the middle. Desirably, the shaft 72 is relatively smooth and has a polished surface for frictionless movement when rotated. On the other hand, the surface of each knob 74 is advantageously relatively rough for frictional engagement with a human thumb, to facilitate turning of the rod 70 by a thumb. The difference in surface characteristics of the knobs 74 and shaft 72 may be obtained by finishing the article in apparatus of the invention 76 (see FIG. 11). The surface of gear 75 remains unfinished and not modified by corresponding to relief zones in the apparatus of FIG. 11. FIG. 11 is a view-in-perspective of another embodiment apparatus of the invention, which differs essentially from apparatus 50 (FIG. 4) in that a single groove 54 transverses only partially the surface of block 52 and is formed in the negative image (in profile) of the lower half of rod 70. Another difference is that block 52 is fabricated from two different grades of abrasive. In this way, abrasive surface 32 has a coarse abrasive in portion 80 corresponding to the negative image of the surface for knob 74 and a finer grade of abrasive surface 84 in the area of the negative image for shaft 72. In this manner, when the article 70 is rotated in groove 54 of apparatus 76, a rougher, frictional grip finish is imparted to the surface of knob 74 and a smoother, frictionless surface is given to the shaft 72. Alternatively, the apparatus 76 (open or closed) may be rotated about the article for finishing. Relief surface 82 is found in the groove 54 to leave the gear 75 surface unmodified.

Figures 12, 13:
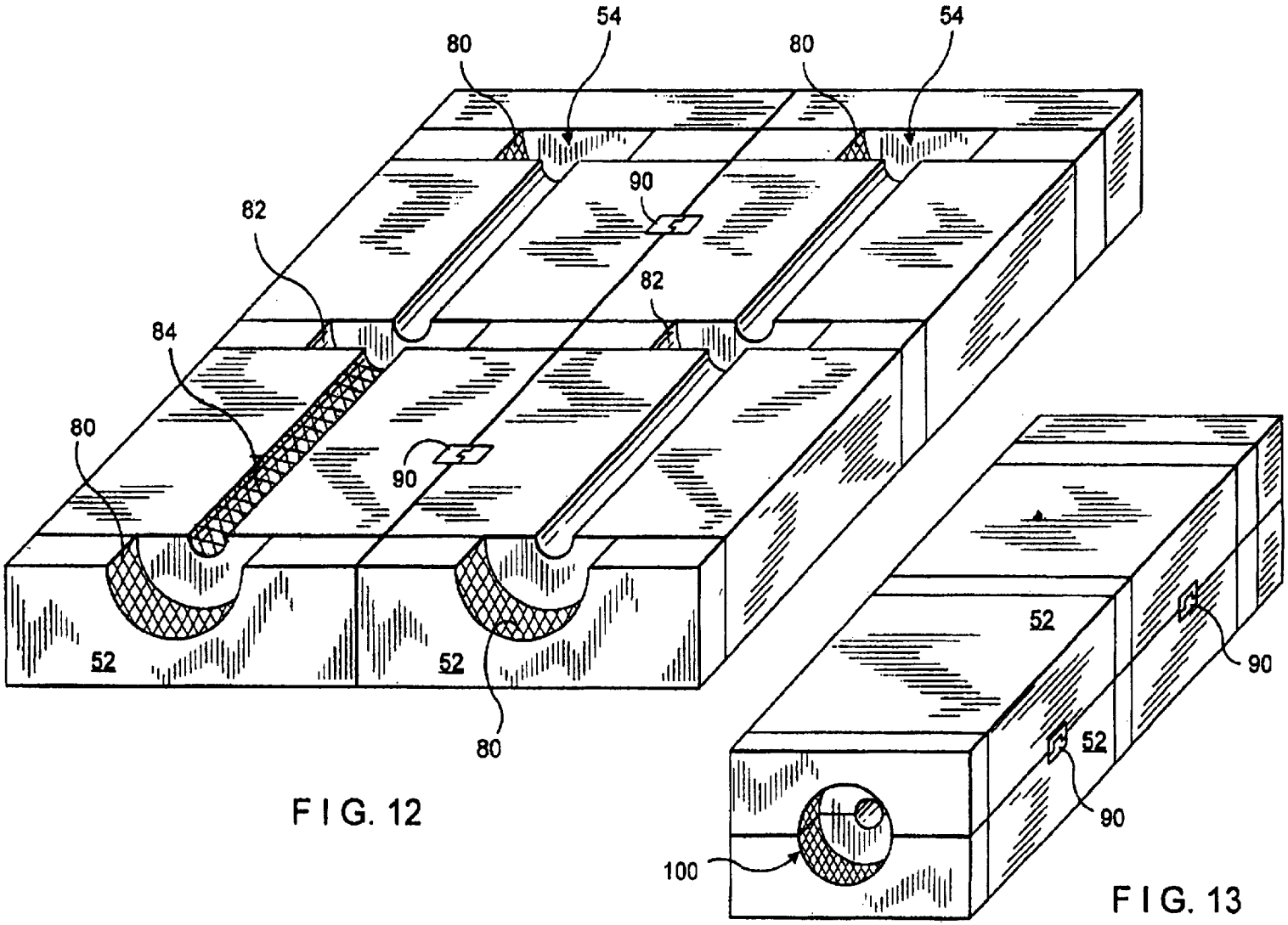
FIG. 12 is a view of a multi-segmented apparatus of the invention.
FIG. 13 is a view of the embodiment apparatus of FIG. 12 shown closed.

FIG. 12 is a view of a multi-segmented apparatus of the invention, wherein two halves (each identical to block 52) are secured together by hinges 90 so that when the article rod 70 is inserted in groove 52, both halves of rod 70 may be finished upon rotation of the article in the groove, simultaneously. FIG. 13 is a view of the multi-segmented apparatus of FIG. 12 closed, the respective grooves 54 forming a bore 100 in the assembled blocks 52.

As used throughout the specification and claims, the term "abrasive surface" includes surfaces fabricated from sandpaper, emory cloth, diamond surfaces, steel wools, jeweler's rouge, liquid abrasives and all conventional and known abrasives in their various abrasive grades, ranging from coarse to very fine grit or particle size. Thus, the abrasive surfaces may be fabricated from materials which differ from or are identical to the material comprising the support means.

What is claimed is:

1. A finishing device for tools' surfaces comprising a block designed to abrade, cut or otherwise finish surfaces of said tools, said block having at least two components which, when brought together, form a single block structure containing a finishing cavity, disposed therein, said cavity comprising at least a portion of a negative image surface of a portion of said tool to be finished, said cavity further comprising at least one groove formed inside said cavity, for receiving a distal end of said tool or instrument for the purpose of finishing said distal end when said tool is moved relative to said at least one groove, said at least one groove having an active, cutting surface for finishing said distal end.

2. The finishing device in accordance with claim 1, wherein said active, cutting surface is disposed adjacent to a relief surface for capturing cutting residues or discharging residues from said tool.

3. The finishing device in accordance with claim 1, wherein said active, cutting surface comprises a curvilinear-shaped wall.

4. A finishing device for tools' surfaces comprising a block designed to abrade, cut or otherwise finish surfaces of said tools, said block having at least two components which, when brought together, form a single block structure containing a finishing cavity, disposed therein, at least a portion of said finishing cavity having a cross-sectional profile that is a negative image of a portion of said tool to be finished, at least one groove for receiving a distal end of said tool or instrument for the purpose of finishing said distal end when said tool is moved relative to said groove, said at least one groove having an active, cutting surface for finishing said distal end, wherein said active, cutting surface is disposed adjacent to a relief surface for capturing cutting residues or discharging residues from said tool.

5. A finishing device for tools' surfaces comprising a block designed to abrade, cut or otherwise finish surfaces of said tools, said block having at least two components which, when brought together, form a single block structure containing a finishing cavity, disposed therein a negative image at least a portion of said finishing cavity having a cross-sectional profile that is said tool to be finished, at least one groove receiving a distal end of said tool or instrument for the purpose of finishing said distal end when said tool is moved relative to said groove, said at least one groove having an active, cutting surface for finishing said distal end, wherein said active, cuffing surface comprises a curvilinear-shaped surface.

6. A finishing device for tools' surfaces comprising:

a block designed to abrade, cut or otherwise finish surfaces of said tools, said block having at least two components which, when brought together, form a block structure;

at least one groove formed in said block structure for receiving at least a portion of said tool or instrument for the purpose of finishing at least one surface of said tool when said tool is moved relative to said at least one groove;

at least a portion of said groove having a cross-sectional profile that is a negative image of a portion of said tool to be finished for supporting said tool; and at least one cutting surface for finishing said at least one end of said tool, wherein said groove provides access to said cutting surface.

7. The finishing device for tools' surfaces of claim 6, further comprising a relief surface adjacent said cutting surface.

8. The finishing device for tools' surfaces of claim 7, wherein said relief surface is a negative image surface.

9. The finishing device for tools' surfaces of claim 7, wherein said relief surface captures cutting residues or discharging residues from said tool.

10. A finishing device for tools' surfaces comprising:

a block designed to abrade, cut or otherwise finish surfaces of said tools, said block having at least two components which, when brought together, form a block structure; at least one groove formed in said block structure for receiving at least a portion of said tool or instrument for the purpose of finishing at least one surface of said tool when said tool is moved relative to said at least one groove;

at least a portion of said groove having a cross-sectional profile that is a negative image of a portion of said tool to be finished;

a relief surface for non-abrasively supporting a portion of said tool; and a cutting surface for finishing said distal end, wherein said groove provides access to said cutting surface.

11. The finishing device for tools' surfaces of claim 10, wherein said relief surface is formed on a surface of said groove.

12. The finishing device for tools' surfaces of claim 11, wherein the cutting surface is a negative image surface.

13.The finishing device for tools' surfaces of claim 11, wherein the relief surface is a negative image surface.

14. The finishing device for tools' surfaces of claim 10, wherein the relief surface is adjacent said cutting surface.

15. The finishing device for tools' surfaces of claim 10, wherein the relief surface is metal.

* * * * *